US005355536A

United States Patent [19]

Prisco

[11] Patent Number: 5,355,536

[45] Date of Patent: Oct. 18, 1994

[54] VENTILATED TOILET SEAT ASSEMBLY

[76] Inventor: Anthony Prisco, 3600 Redwood, Las Vegas, Nev. 89103

[21] Appl. No.: 914,876

[22] Filed: Jul. 16, 1992

Related U.S. Application Data

[63] Continuation-in-part of Ser. No. 633,970, Dec. 26, 1990, Pat. No. 5,170,512, which is a continuation-in-part of Ser. No. 481,344, Feb. 16, 1990, Pat. No. 5,010,600.

[51] Int. Cl.[5] ..... E03D 9/04

[52] U.S. Cl. ..... 4/217; 4/352

[58] Field of Search ..... 4/213, 216, 217, 347–352

[56] References Cited

U.S. PATENT DOCUMENTS

| | | | |
|---|---|---|---|
| 1,794,635 | 3/1931 | Mills | 4/217 |
| 2,240,130 | 4/1941 | Carothers | 4/213 |
| 3,108,289 | 10/1963 | Smith | 4/213 |
| 3,192,539 | 7/1965 | Martz | 4/218 |
| 3,359,884 | 12/1967 | Statter | 98/43 |
| 3,600,724 | 8/1971 | Stamper | 4/217 |
| 3,896,509 | 7/1975 | Stipp | 4/209 |
| 3,916,059 | 11/1975 | Ivancevic | 4/217 X |
| 3,938,201 | 2/1976 | McGrew | 4/213 |
| 3,967,545 | 7/1976 | Baker | 98/43 |
| 3,999,225 | 12/1976 | Ables | 4/213 |
| 4,007,498 | 2/1977 | Pearson | 4/213 |
| 4,125,906 | 11/1978 | Weiland | 4/217 |
| 4,165,544 | 8/1979 | Barry | 4/213 |
| 4,175,293 | 11/1979 | Stephens | 4/209 |
| 4,232,406 | 11/1980 | Beeghly | 4/213 |
| 4,251,888 | 2/1981 | Turner | 4/213 |
| 4,402,091 | 9/1983 | Ellis et al. | 4/217 |
| 4,556,999 | 12/1985 | Lindley | 4/217 |
| 4,701,966 | 10/1987 | Schafer | 4/213 |
| 4,882,790 | 11/1989 | Ricard | 4/213 |

FOREIGN PATENT DOCUMENTS

| | | | |
|---|---|---|---|
| 2630318 | 10/1989 | France | 4/348 |

*Primary Examiner*—Charles E. Phillips
*Attorney, Agent, or Firm*—John Edward Roethel

[57] ABSTRACT

A bathroom exhaust system includes a ventilated toilet seat assembly, one or more exhaust lines connected to the ventilated toilet seat through a mounting block attached to the toilet bowl behind the toilet seat and an exhaust fan located in or adjacent to the ceiling of the bathroom. The exhaust fan is vented to the outside atmosphere and is controlled by an electrical switch mounted on the wall of the bathroom. The ventilated toilet seat assembly includes a toilet seat that has a hollow interior and is provided with a plurality of vent apertures permitting communication with the interior of the toilet bowl. An exhaust line is provided at the rear of the toilet seat and cooperates with an exhaust passageway in a mounting block attached to the top of the toilet bowl just in front of the water tank and behind the toilet seat. The mounting block also includes the hinges for pivoting the toilet seat. One or more exhaust couplings extend from the end of the mounting block and a flexible exhaust hosing is attached to the exhaust couplings and extends therefrom to the exhaust fan located in an exhaust fan housing in the ceiling of the bathroom.

6 Claims, 3 Drawing Sheets

VENTILATED TOILET SEAT ASSEMBLY

CROSS-REFERENCE TO RELATED APPLICATION

This application is a continuation-in-part of application Ser. No. 07/633,970, filed Dec. 26, 1990, now U.S. Pat. No. 5,170,512, which in turn is a continuation-in-part of application Ser. No. 07/481,344, filed Feb. 16, 1990, entitled "Toilet Odor Removal System" now U.S. Pat. No. 5,010,600, issued Apr. 30, 1991.

BACKGROUND OF THE INVENTION

This invention relates to a ventilated toilet seat assembly, and more particularly to ventilated toilet seat assembly in which the exhaust line from the toilet seat to the suction or vacuum source is opened and closed through the action of the toilet seat being hinged on a mounting block connected to the top of the toilet bowl. The ventilated toilet seat assembly is included as part of a bathroom exhaust system to remove noxious odors from the toilet bowl area and the bathroom, in general.

Modern building codes require that rooms housing toilets be provided with an exhaust system vented to the atmosphere. This is especially so when the room is a small one not having any opening in the exterior wall, such as a window that can be opened to allow fresh air to enter the room. It has been long recognized that the strongest source of noxious odors or vapors occurs at the toilet seat when the same is occupied by a person.

In the past a number of systems have been proposed for the elimination or reduction of the noxious vapors emanating from the toilet and the room in which the toilet is housed. Many of the systems involve modifications to the toilet seat to accommodate odor exhaust devices. Examples of such modified seats are disclosed in U.S. Pat. No. 3,192,539 to Martz; U.S. Pat. No. 3,600,724 to Stamper et al.; U.S. Pat. No. 3,999,225 to Ables; U.S. Pat. No. 4,175,293 to Stephens et al.; U.S. Pat. No. 4,125,906 to Weiland; U.S. Pat. No. 4,251,888 to Turner; U.S. Pat. No. 4,402,091 to Ellis; U.S. Pat. No. 4,556,999 to Lindley and U.S. Pat. No. 4,882,790 to Ricard.

In order for an odor exhaust device to function, a bathroom must have a source of suction or vacuum. Most building codes require an exhaust system including an exhaust fan located in the ceiling or wall of the room in which the toilet is housed. There also must be an arrangement that permits the noxious odors from the toilet bowl area to be withdrawn into the exhaust system. Many of the previously proposed devices utilized vents and other apertures in the toilet seat and toilet lid communicating with passageways adjacent to the rear of the toilet seat and connected to one or more exhaust lines to the source of suction or vacuum. Other devices require adding extra parts to the toilet seat assembly to provide the venting passageways.

It is an object of the present invention to provide a ventilated toilet seat that is easy to assemble onto an existing toilet bowl. It is a further object of the present invention to provide for a clean and aesthetic assembly that replaces the existing toilet seat with a minimum of replacement parts.

It is a feature of the present invention to utilize vent apertures opening into a hollow interior provided in the toilet seat and an exhaust passageway in the mounting block behind the toilet seat to connect the ventilated toilet seat to the suction or vacuum system. It is a further feature of the present invention that the exhaust passageway in the mounting block behind the toilet seat disconnects from the vent apertures and the hollow interior in the toilet seat when the toilet seat is pivoted upwardly about the hinges attached to the mounting block.

It is an advantage of the present invention that a ventilated toilet seat assembly can be assembled onto an existing toilet bowl by simply replacing the toilet seat with a hollow toilet seat and mounting block and thus provide an aesthetically pleasing and relatively inexpensive assembly to remove noxious odors from the toilet bowl area.

Other objects, features and advantages of the present invention will become apparent from a consideration of the following detailed description.

SUMMARY OF THE INVENTION

A bathroom exhaust system includes a ventilated toilet seat assembly, one or more exhaust lines connected to the ventilated toilet seat through a mounting block attached to the toilet bowl behind the toilet seat and an exhaust fan located in or adjacent to the ceiling of the bathroom. The exhaust fan is vented to the outside atmosphere and is controlled by an electrical switch mounted on the wall of the bathroom.

The ventilated toilet seat assembly includes a toilet seat that has a hollow interior and is provided with a plurality of vent apertures permitting communication with the interior of the toilet bowl. An exhaust line is provided at the rear of the toilet seat and cooperates with an exhaust passageway in a mounting block attached to the top of the toilet bowl just in front of the water tank and behind the toilet seat. The mounting block also includes the hinges for pivoting the toilet seat. One or more exhaust couplings extend from the end of the mounting block and a flexible exhaust hosing is attached to the exhaust couplings and extends therefrom to the exhaust fan located in an exhaust fan housing in the ceiling of the bathroom.

DETAILED DESCRIPTION OF THE PREFERRED EMBODIMENTS

Figure 1:
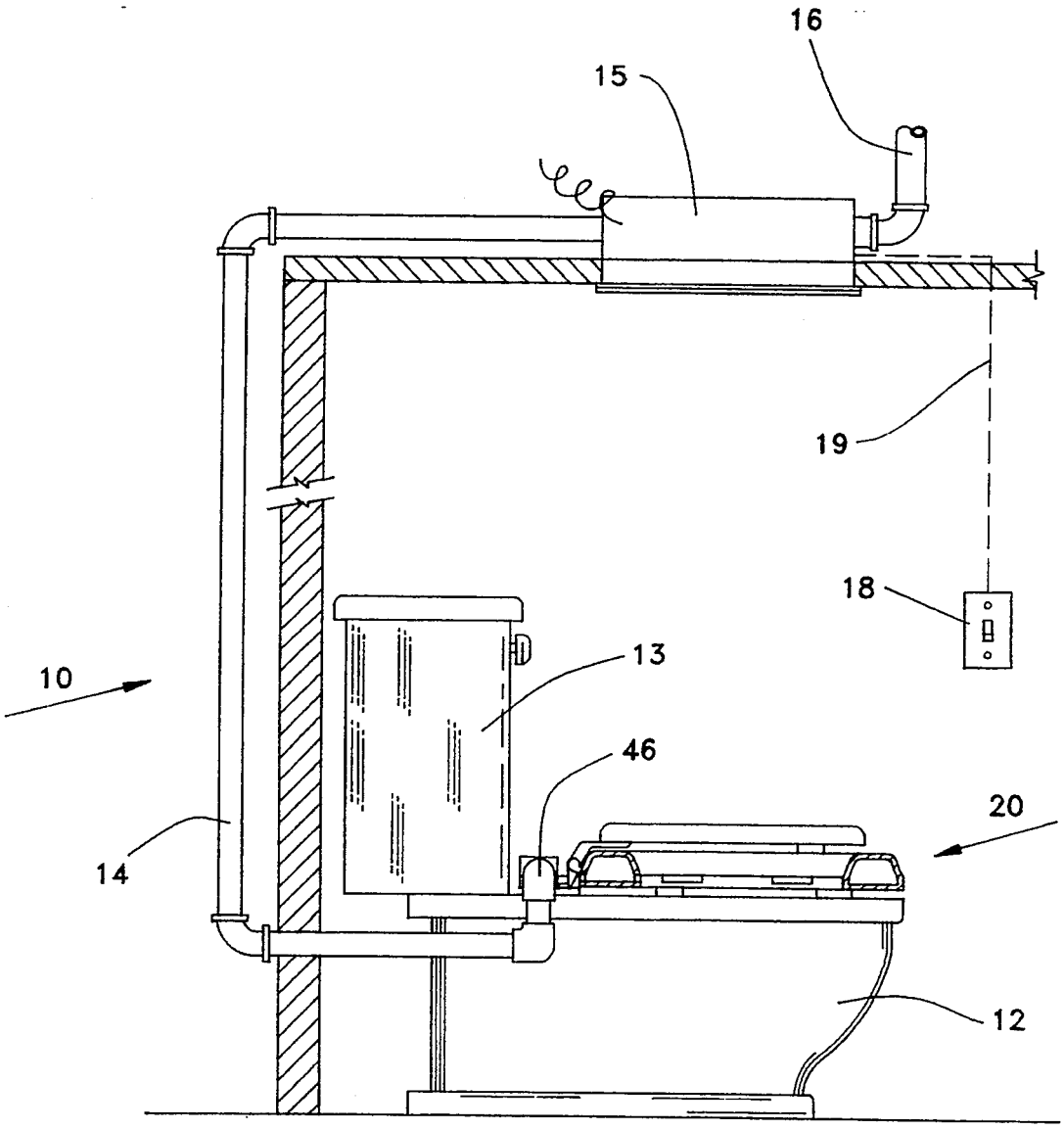
FIG. 1 shows an overall side view of the ventilated toilet seat assembly of the present invention.

The bathroom exhaust system of the present invention is shown generally at 10 in FIG. 1. A standard toilet bowl 12 and a standard toilet tank 13 are provided with a ventilated toilet seat assembly. The ventilated toilet seat assembly has connected thereto at least one exhaust line 14 that extends to the rear of the toilet bowl 12 and through a wall of the bathroom. The exhaust line 14 extends through the interior space behind the bathroom wall and up into the bathroom ceiling where it is attached to an exhaust fan housing 15. The exhaust fan housing 15 includes an outside vent line 16 that extends upwardly and terminates at an outlet venting to the outside atmosphere.

The exhaust fan housing 15 is provided with a suitable exhaust fan arrangement (not shown) that provides suction or vacuum to the exhaust fan housing 15 and in turn to the ventilated toilet seat assembly. Any suitable exhaust fan arrangement can be used; in the preferred embodiment, one of the exhaust fan arrangements disclosed in U.S. Pat. No. 5,010,600 to Prisco or in U.S. application Ser. No. 07/633,970 to Prisco, the disclosures of which are incorporated herein by this reference thereto, can be used to exhaust noxious odors not only from the interior of the toilet bowl but also from the interior of the bathroom as well. The exhaust fan arrangement is operated by means of a switch 18 connected to the exhaust fan by electrical line 19.

Figure 2:
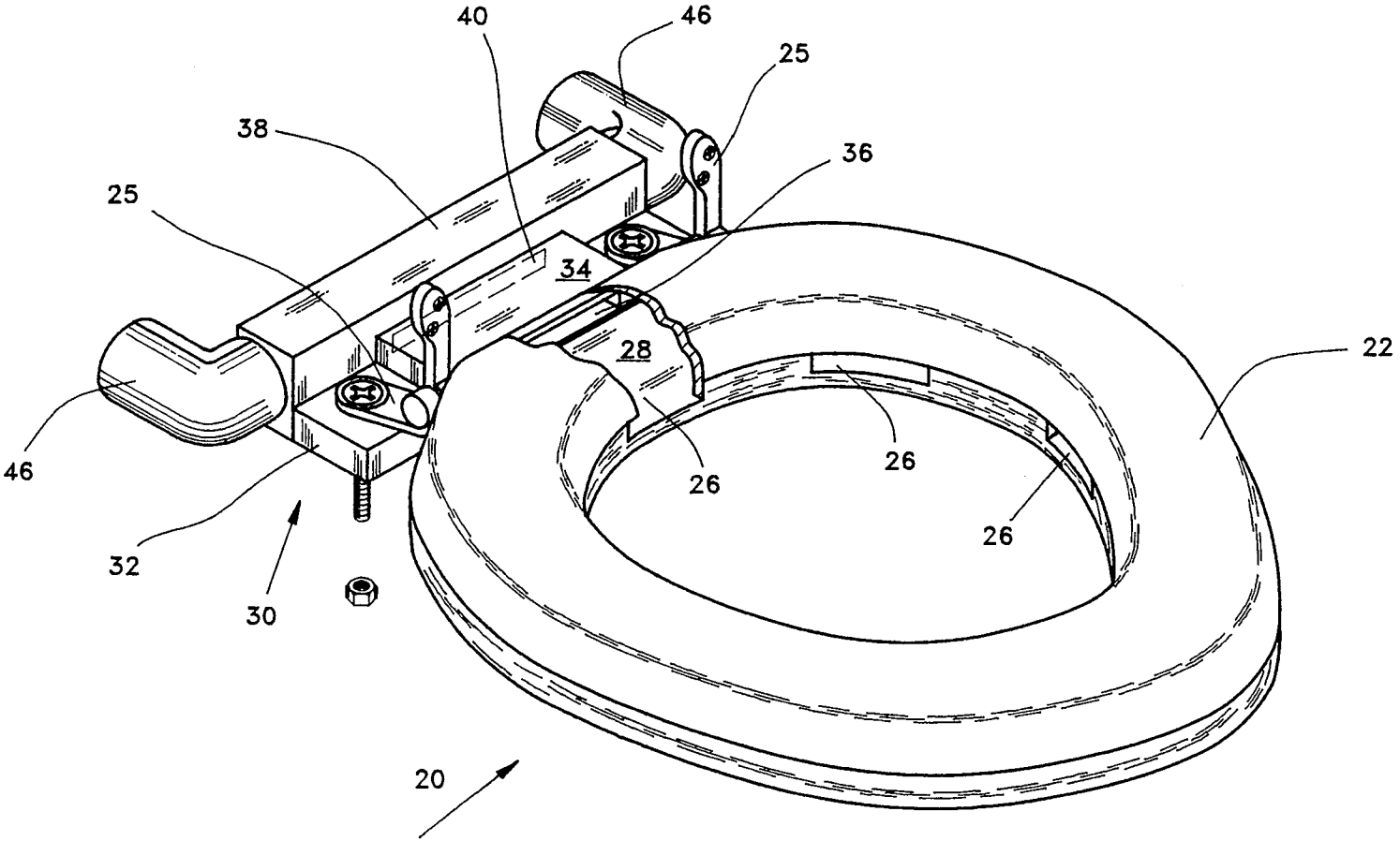
FIG. 2 shows a perspective view of the ventilated toilet seat, mounting block, hinges and exhaust couplings of the present invention in the closed position.
Figure 3:
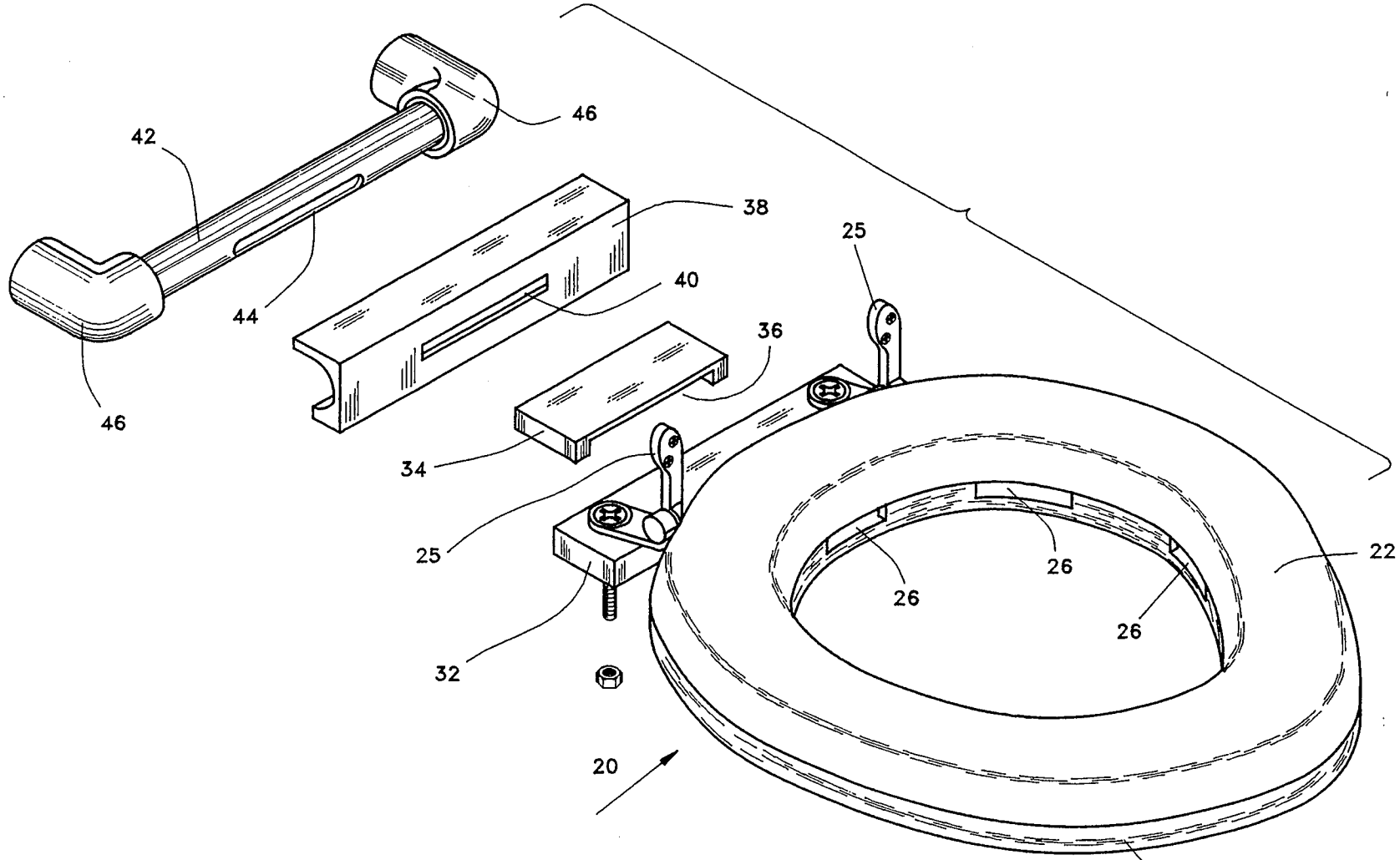
FIG. 3 shows an exploded perspective view of the ventilated toilet seat, mounting block, hinges and exhaust couplings of the present invention in the closed position.

The details of the ventilated toilet seat assembly are shown in FIGS. 2 and 3. A generally circular toilet seat 22 is provided with a generally circular ventilated seat base 24. The toilet seat 22 and the seat base 24 join together and have a hollow interior 28. Alternatively, the toilet seat 22 and the seat base 24 can be formed as an integral unit.

A plurality of vent apertures 26 are disposed around the internal perimeter of the toilet seat 22 and ventilated seat base 24 and open into the hollow interior 28 of the toilet seat 22 and ventilated seat base 24. The toilet seat 22 and ventilated seat base 24 are connected by means of conventional hinges 25 to the mounting block 30. The hinges 25 permit the toilet seat 22 and ventilated seat base 24 to be raised and lowered around the hinges 25 on the mounting block 30. The hinges shown are merely illustrative of hinges that could be used and any appropriate hinge arrangement that allows the toilet seat 22 and ventilated seat base 24 to pivot upwardly can be utilized.

The mounting block 30 is securely fastened in any conventional manner to the upper rear area of the toilet bowl 12 and just forward of the toilet tank 13. The mounting block 30 comprises a base plate 32 which provides a surface for the attachment of the mounting block 30 to the toilet bowl 12 and for receiving the hinges 25. A top vent plate 34 is attached to the upper side of the base plate 32 on the toilet seat side of the base plate 32 and a rear top block 38 is attached to the base plate 32 behind the top vent plate 34.

The rear top block 38 has a rear top block passageway 40 that extends from the front of the rear top block passageway 40 therethrough to the rear. The top vent plate 34 also includes a top vent plate passageway 36 that extends therethrough from the front to the rear of the top vent plate 34. One side of the top vent plate passageway 36 communicates with the hollow interior 28 of the toilet seat 22 and the other side of the top vent plate passageway 36 communicates with the rear top block passageway 40 on the interior of the rear top block 38.

Attached to the rear of the rear top block 38 is a hollow tubular member 42 that also has a hollow tubular member opening 44 that aligns and communicates with the rear top block passageway 40 in the rear top block 38. At each end of the hollow tubular member 42 is a hollow coupling 46. One of the hollow couplings 46 attaches to the exhaust line 14. The other hollow coupling 46 may be closed off or it may be attached to a second exhaust line 14 that is also disposed through the bathroom and attached at its other end to the exhaust fan housing 15.

In use, the bathroom exhaust system 10 is activated by flipping of the switch 18 which turns on the exhaust fan in the exhaust fan housing 15 and provides suction or vacuum through the exhaust line 14. This suction or vacuum causes noxious odors to be withdrawn from the toilet bowl through the vent apertures 26 in the toilet seat 22 and ventilated seat base 24. The noxious odors pass into the hollow interior 28 of the toilet seat 22 and from there through the top vent plate passageway 36 of the top vent plate 34 and the rear top block passageway 40 of the rear top block 38 and into the hollow tubular member 42 through the hollow tubular member opening 44. The suction or vacuum draws the noxious odors from the rear top block 38 through the hollow coupling 46 and into the exhaust line 14. The noxious odors travel through the exhaust line 14 and into the exhaust fan housing 15 from which they are finally exhausted through outside vent line 16 into the outside atmosphere.

If the exhaust fan housing 15 is provided with vent openings that communicate through the ceiling with the interior of the bathroom, noxious odors will also be drawn from the bathroom and vented to the outside atmosphere.

When the toilet seat 22 and ventilated seat base 24 are pivoted upwardly about the hinges 25, the suction or vacuum from the exhaust fan housing 15 will be disconnected from the hollow interior 28 of the toilet seat 22. This eliminates any suctioning from the toilet bowl and the exhaust fan housing 15 will only draw odors from the interior of the bathroom.

While the invention has been illustrated with respect to several specific embodiments thereof, these embodiments should be considered as illustrative rather than limiting. Various modifications and additions may be made and will be apparent to those skilled in the art. Accordingly, the invention should not be limited by the foregoing description, but rather should be defined only by the following claims.

What is claimed is:

1. A ventilated toilet seat assembly comprising:

a) a hollow toilet seat including a hollow seat base attached thereto;

b) at least one vent aperture in the toilet seat opening into the hollow interior thereof;

c) a mounting block attached to the toilet seat;

d) the mounting block including a top vent plate having a passageway therethrough communicating with the hollow interior of the toilet seat when the toilet seat is in a lowered position;

e) the mounting block further including a rear top block with a passageway therethrough communicating with the passageway in the top vent plate;

f) a hollow tubular member attached to the rear top block and including an opening therein that communicates with the passageway in the rear top block;

g) at least one hollow coupling joined to the hollow tubular member; and h) means for pivotally connecting the toilet seat to the mounting block so that the passageway in the top vent plate can be disconnected from the hollow interior of the toilet seat while at the same time the passageway in the top vent plate remains in communication with the passageway in the rear top block and the hollow tubular member when the toilet seat is in a raised position whereby when the ventilated toilet seat assembly is connected to a source of suction, noxious odors from a toilet can be exhausted through the ventilated toilet seat assembly when the toilet seat is in the lowered position and noxious odors can be exhausted directly through the passageway in the top vent plate when the toilet seat is in the raised position and the communication between the toilet seat and the source of suction is disconnected.

2. The ventilated toilet seat assembly of claim 1 wherein the toilet seat includes a plurality of vent apertures evenly spaced around the internal periphery of the toilet seat.

3. The ventilated toilet seat assembly of claim 1 wherein the means for pivotally connecting the mounting block to the toilet seat is at least one hinge attached to the mounting block and the toilet seat.

4. A bathroom exhaust system comprising:

a) ventilated toilet seat assembly comprising:

1) a hollow toilet seat including a hollow seat base attached thereto;

2) at least one vent aperture in the toilet seat opening into the hollow interior thereof;

3) a mounting block attached to the toilet seat;

4) the mounting block including a top vent plate having a passageway therethrough communicating with the hollow interior of the toilet seat when the toilet seat is in a lowered position;

5) the mounting block further including a rear top block with a passageway therethrough communicating with the passageway in the top vent plate;

6) a hollow tubular member attached to the rear top block and including an opening therein that communicates with the passageway in the rear top block;

7) at least one hollow coupling joined to the hollow tubular member; and 8) means for pivotally connecting the toilet seat to the mounting block so that the passageway in the top vent plate can be disconnected from the hollow interior of the toilet seat while at the same time the passageway in the top vent plate remains in communication with the passageway in the rear top block and the hollow tubular member when the toilet seat is in a raised position;

b) an exhaust line attached at one end to the hollow coupling;

c) an exhaust fan housing, including an exhaust fan, attached to the other end of the exhaust line; and d) an outside vent line attached to the exhaust fan housing whereby when the ventilated toilet seat assembly is connected to the exhaust fan housing, noxious odors from a toilet can be exhausted through the ventilated toilet seat assembly to the outside atmosphere when the toilet seat is in the lowered position and noxious odors can be exhausted directly through the passageway in the top vent plate to the outside atmosphere when the toilet seat is in the raised position and the communication between the toilet seat and the exhaust fan housing is disconnected.

5. The ventilated toilet seat assembly of claim 4 wherein the means for pivotally connecting the mounting block to the toilet seat is at least one hinge attached to the mounting block and the toilet seat.

6. The ventilated toilet seat assembly of claim 4 wherein the toilet seat includes a plurality of vent apertures evenly spaced around the internal periphery of the toilet seat.

* * * * *